United States Patent [19]

Gloor et al.

[11] Patent Number: 4,530,454

[45] Date of Patent: Jul. 23, 1985

[54] DEVICE FOR DRIVING NAILS AND SIMILAR FASTENING ELEMENTS

[75] Inventors: Peter Gloor, Zollikerberg, Switzerland; Hans Gschwend, Vaduz, Liechtenstein; Fritz Mark, Mäder, Austria; Lukas Matt, Mauren, Liechtenstein

[73] Assignee: Hilti Aktiengesellschaft, Schaan, Liechtenstein

[21] Appl. No.: 540,816

[22] Filed: Oct. 11, 1983

[30] Foreign Application Priority Data

Oct. 11, 1982 [DE] Fed. Rep. of Germany ..... 3237616

[51] Int. Cl.[3] ..... B25C 1/06

[52] U.S. Cl. ..... 227/129; 173/53; 227/131

[58] Field of Search ..... 173/1, 124, 53, 121; 227/8, 131, 129

[56] References Cited

U.S. PATENT DOCUMENTS

| | | | |
|---|---|---|---|
| 4,161,272 | 7/1979 | Brockl | 227/131 |
| 4,204,622 | 5/1980 | Smith et al. | 227/131 |
| 4,323,127 | 4/1982 | Cunningham | 227/131 X |
| 4,449,660 | 5/1984 | Smith | 227/131 X |

*Primary Examiner*—Paul A. Bell

*Attorney, Agent, or Firm*—Toren, McGeady, Stanger, Goldberg & Kiel

[57] ABSTRACT

A device for driving nails and similar fastening elements includes a driver rod performing a reciprocating stroke-like movement for placing the nails. A rotating driving element transmits the driving power to the driver rod so that it carries out the stroke-like movement. During the nail driving operation, the rotating driving element is coupled with the driver rod by a carrier. The carrier is secured to the driving element and moves along an elongated path in converting the rotational movement of the driving element into the stroke-like movement of the driver rod.

16 Claims, 13 Drawing Figures

DEVICE FOR DRIVING NAILS AND SIMILAR FASTENING ELEMENTS

SUMMARY OF THE INVENTION

The present invention is directed to a device for driving nails and similar fastening elements and includes a driver rod and a driving element. The driving element is rotated by a drive motor and, in turn, is coupled to the driver rod which performs a stroke-like movement.

A motor-operated device for driving nails and the like is known. A driver rod, supported for axial displacement, is driven forwardly in the driving step by a driving element which is in the form of a flywheel rotatably driven by a motor. The rotational movement is converted into a stroke-like movement by the rolling of the flywheel at the driver rod. The driver rod is supported by a movable roller. The force transmission from the flywheel to the driver rod is effected by a frictional type engagement. The transmitted forces fluctuate based on the friction engagement between the flywheel and the driver rod and such engagement is determined by the type and make-up of the materials involved and also by the contact pressure and external influences, such as moisture and the like. In a driving operation, which requires great power consumption, a slipping loss often occurs so that the fastening element is not adequately driven in.

Therefore, the primary object of the present invention is to provide a device for driving in nails and similar fastening elements where the driving force supplied by a drive motor is transmitted to the driver rod for inserting the fastening element in a manner free of any driving power losses.

In accordance with the present invention, the drive motor powers a driving element which includes a carrier and the carrier is arranged so that it executes a generally elongated movement corresponding to the stroke-like movement of the driver rod. A coupling device connects the carrier to the driver rod during the rotational cycle of the driving element.

After the coupling is effected, the carrier moves the driver rod at least in the driving direction. The driver rod can be returned into the starting or at-rest position, in the direction opposite to the driving direction, by separate return means, such as springs or the like, or the driver rod can be returned by the carrier. Accordingly, in one arrangement the carrier and drive rod are uncoupled approximately after the completion of half of the rotational cycle of the driving element with the remainder of the rotational cycle used for returning the carrier. As a result, the output from the drive motor is available for driving the fastening elements without any slipping losses.

The elongated movement of the carrier can be produced by a crank drive or a curved gear. The carrier can be located on the structural component which is displaced in a rectilinear manner by the crank or gear.

With regard to the arrangement and size of the device as well as the movement transmission, an advantageous solution is afforded when the carrier is located on a planet pinion rotated by the driving element as it rolls in meshed engagement with a hollow gear wheel where the pitch diameter of the planet pinion corresponds to half of the pitch diameter of the hollow gear wheel.

All of these solutions afford an approximately sine-shaped curve and, therefore, an ideal velocity curve for the carrier. Accordingly, it is possible to effect the engagement and disengagement during the phase of the lowest velocity of the carrier. Thus, minimal wear of the parts of the device is assured along with an unimpeded coupling operation.

By mounting the carrier on a planet pinion, long paths of the carrier or driver rod can be obtained with a relatively small device. Moreover, the meshed engagement of the planet pinion with the hollow gear wheel, which is supported at the housing of the device, ensures that the rotational energy directed around the axis of the planet pinion is transmitted to the driver rod during the driving operation according to the principle of a flywheel mass.

Based on another feature of the invention, a compact construction of the device with maximum stroke length of the path traveled by the carrier is attained when the axis of the carrier, located parallel to the axis of the planet pinion, is located outside the pitch diameter or circle of the planet pinion. As a result, the path of movement of the carrier diverges from a straight line to a narrow elongated elliptical path approximating the straight line. A movement of the driver rod free from the risk of tilting can also be achieved in the same way. The displacement of the carrier axis beyond the pitch diameter or circle of the planet pinion may be as much as 20% and preferably approximately 10%, of the pitch diameter.

It is advantageous if at least one support gear, in meshed engagement within the hollow gear wheel, is connected with the driving element. The support gear relieves the support of the driving element and affords mass compensation for the rotating drive unit so that the drive unit is distinguished by uniform running operation. The support gear runs synchronously with the planet pinion around the rotational axis of the driving element and, accordingly, forms an additional kinetic storage for the mass. The storage effect of the support gear is fully utilized in a slip-free manner due to its meshed engagement with the hollow gear wheel so that the rotational energy acting around the axis of the support gear is available for the driving operation.

To obtain the most extensive obstruction-free meshed rolling of the planet pinion and the support gear, the support gear has a rim with a diameter corresponding approximately to the pitch diameter of the planet pinion. Accordingly, the planet pinion and support gear roll along a smooth rotational path of the hollow gear wheel.

The carrier can be constructed in different ways. For example, it can be in the form of a pocket with a mouth-like opening so that a bolt-like element on the driver rod couples with the opening. Preferably, the carrier is formed as a crank pin secured to the planet pinion. Such an arrangement is distinguished by its simplicity, reliability and strength.

Another feature of the invention is the arrangement of an opening for receiving the carrier which arrangement has proven to be simple yet secure for the coupling operation.

In one embodiment, the receiving opening for the carrier is in the form of a hook pivotally mounted on the driver rod. When the driver rod is in a rear or retracted position, the carrier moves into the receiving opening of the hook and carries the driver rod along with it in form-locked engagement, initially in the driving direction and later in the return direction.

The coupling with the carrier is achieved by pivoting the hook. It is advantageous for this purpose to provide an actuating device for pivoting the hook into position for connecting the carrier and the driver rod. The actuating device can act on the hook electromagnetically or mechanically. A mechanical actuating device, however, has proven to be advantageous. The mechanical actuating device is provided in the form of a cam on the driving pinion with the cam acting directly or indirectly on the hook. An actuating device in the form of a pivotal lever has proven to be effective as a reliable and simple way of carrying out the control of the device. For such control it is advisable to provide a curved path on the driving element. Accordingly, the pivoting position of the lever can be controlled based on the rotational position of the driving element. Further, the rotational position of the driving element determines the position of the carrier. The curved path on the driving element is arranged so that it pivots the lever for the engagement of the carrier when the carrier or driver rod is located in the retracted position.

The carrier is coupled with the hook at least for the driving stroke of the driver rod. Since the drive motor maintains the driving element in continuous rotation, the driver rod is to be disengaged at a suitable point in time. If a separate means is used for returning the driver rod into the retracted or starting position, such as a spring, the disengagement is effected at the end of the driving stroke. If, however, the carrier effects the return of the driver rod, the disengagement is provided at the end of the retracting stroke. A stop device effects the disengagement by pivoting the hook out of engagement with the carrier. The stop device can be provided in the form of an inclined ramp on the housing so that the hook runs on the ramp. To perform the next driving operation, the lever is placed into the effective region of the curved path and a slider member affords such insertion in an advantageous manner. The slider can be actuated by a mechanical or electromechanical mechanism.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
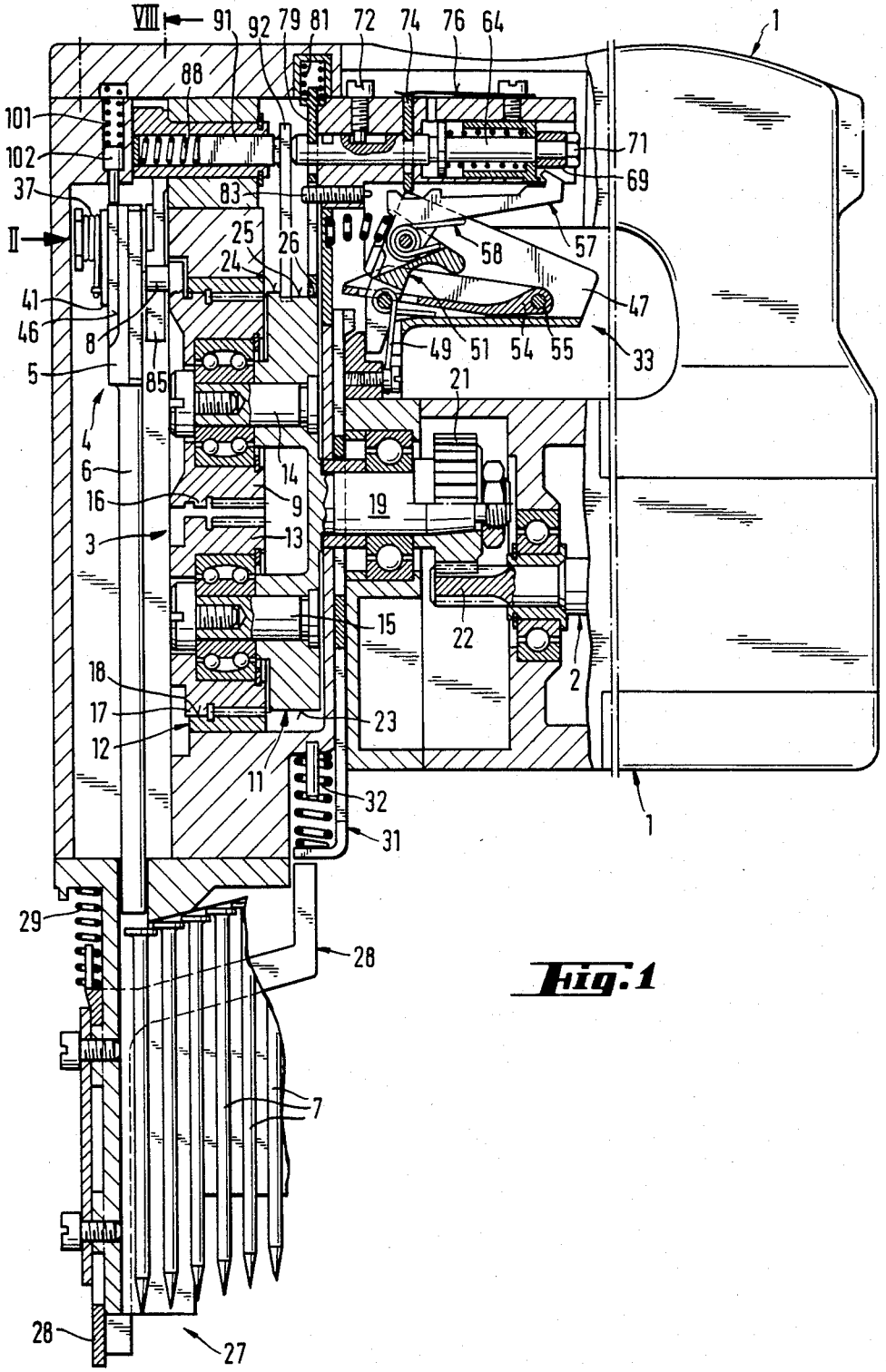
FIG. 1 is a side view, partly in section, of a driving device embodying the presernt invention.

In FIG. 1 a device for driving fastening elements is illustrated including a housing 1, a motor, however, only the drive shaft 2 from the motor is shown for reasons of simplicity, and a rotatable gear unit 3, for converting rotational movement into generally rectilinear driving motion for a driver rod 4.

The driver rod 4 is made up of a head 5 located in the upper portion of the housing shown in FIG. 1 and a shaft or ram 6 extending downwardly from the head for driving nails 7 fed in a magazine to an outlet 27. The nails 7 are driven individually by the device into a workpiece, not shown. During the driving operation, driver rod 4 is driven forwardly, or downwardly as viewed in FIG. 1, against a nail 7 axially aligned with the shaft 6.

The rectilinear driving or stroke motion of the driver rod 4 is provided by a carrier 8 in the form of a crank pin. Carrier 8 is located on the front side, note FIG. 1, of a planet pinion 9 of the gear unit 3, the front side faces the driver rod 4. Planet pinion 9 is rotatably supported on a substantially disk-shaped driving element 11 and is in meshed engagement with a hollow gear wheel 12. The gear wheel 12 is secured in the housing 1 so that it does not rotate. Further, a support gear 13 is also rotatably mounted on the driving element 11 diametrically opposite the planet pinion 9. The support gear 13 is also in meshed engagement with the inside surface of the hollow gear wheel 12.

Planet pinion 9 and the support gear 13 is each supported on a pin 14, 15 positioned on the driving element 11 and each is provided with a wheel rim 16, 17 movable along a smooth circular path 18 on the hollow gear wheel 12.

Driving element 11 is supported in the housing 1 so that it rotates about its central axis. Its central axis is defined by a shaft stub 19 and a pinion 21 is fixed to the shaft stub. Another pinion 22 on the drive shaft 2 of the motor is in meshed engagement with the pinion 21 on the stub.

The pitch diameter of the planet pinion 9 corresponds to half of the pitch diameter of the hollow gear wheel 12. The axis of the pin-shaped carrier 8 is located slightly outside the pitch diameter or circle of the planet pinion 9. During operation of the gear unit 3, carrier 8 describes, for each complete cycle of rotation of the driving element 11, a narrow elliptical path, note FIG. 8. The long or major axis of the elliptical path extends parallel to the axis of the driver rod 4. In addition, driving element 11 has an exterior casing 23 divided into three different rotating curved surfaces 24, 25, 26 arranged in side-by-side relation. In addition, to ensure that the nails are driven from the outlet 27 when the device is pressed against a workpiece, a safety stirrup 28 projects outwardly, downwardly as viewed in FIG. 1, from the outlet 27 of the device, when the device in the rest position. When the outlet 27 of the device is pressed against a workpiece, safety stirrup 28 is pushed into the housing against a compression spring 29 and it displaces a transmission rod 31 via an offset portion of the stirrup. The rod 31 is pressed against the biasing action of a compression spring 32. Rod 31 acts on a trigger device 33.

Figure 2:
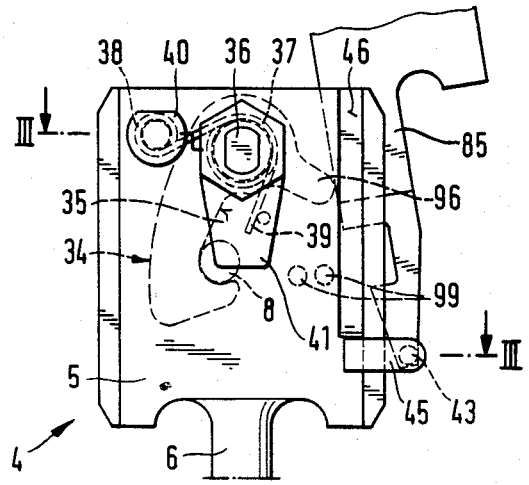
FIG. 2 is a side view of a driver rod taken in the direction of the arrow II shown in FIG. 1.
Figure 3:
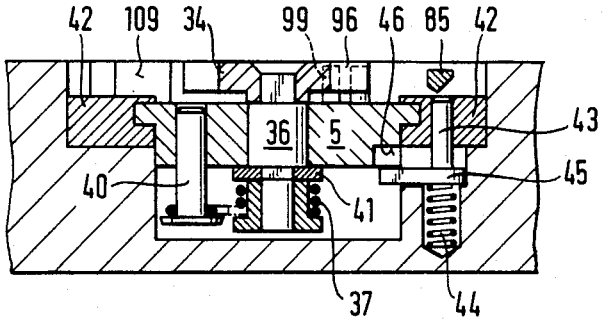
FIG. 3 is a sectional view taken along the line III—III in FIG. 2.

As shown in FIG. 2, the head 5 of driver rod 4 carries a coupling device in the form of a hook 34. To provide engagement with the carrier 8, a receiving opening 35 is provided by an opening along one side of the hook 34. As shown in FIG. 3, hook 34 is fixed on a bearing pin 36 so that it rotates with the pin. A torsion spring 37 is looped around the bearing pin 36 and biases the hook 34 so that its free end is in the path of movement of the carrier 8, that is, it biases the hook in the counterclockwise direction as viewed in FIG. 2. To afford this biasing action, arms 38, 39 of the torsion spring 37 act against a supporting pin 40 and a bracket 41 which is secured in a non-rotatable manner with the bearing pin 36.

Further, in FIG. 3 a retention pin 43 is shown, note also FIG. 2, which is axially displaceable in a guide rail 42 for the head 5. A compression spring 44, mounted in the housing 1, acts on the retention pin 43 so that an arm 45 projecting laterally from the pin rests against the head 5. The side of the head 5 facing the arm 45 is provided with a longitudinally extending recess 46 on the opposite side of the head from the hook 34. When the driver rod 4 is moving in the driving direction, arm 45 drops into the recess 46, and the retention pin 43 projects over the guide rail 42 to perform its retaining function which will be described later. The end of the recess 46 is formed without any stepped arrangement to ensure that the retention pin is forced back into the position shown in FIG. 3 during the return movement of the driver rod 4.

Figure 4:
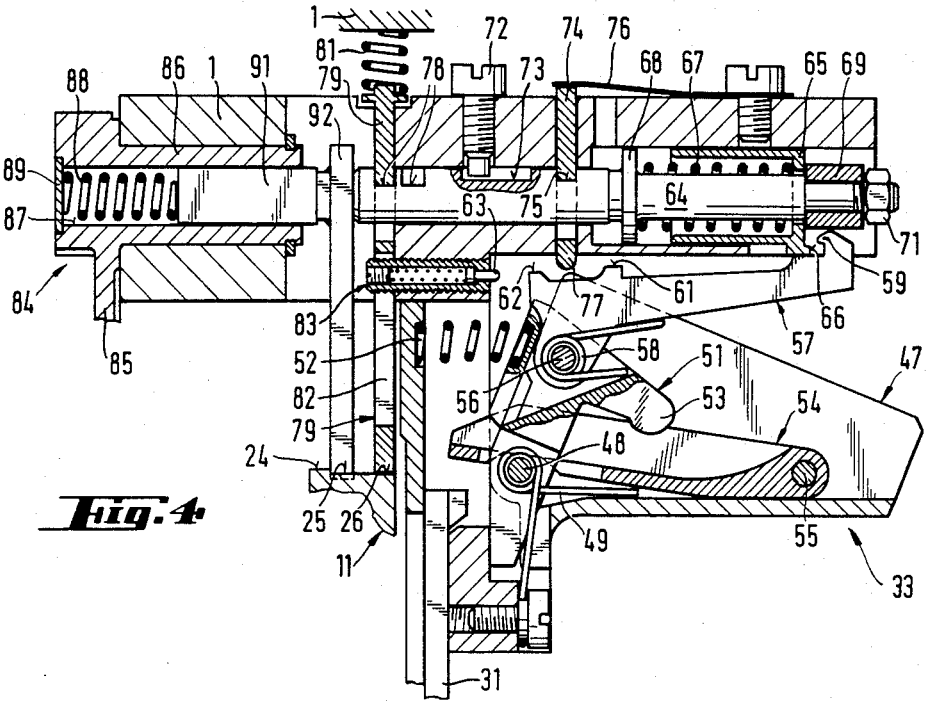
FIGS. 4–7 illustrate different operational positions of a trigger mechanism and of the parts of the device actuated by the trigger mechanism, these figures show a portion of the device as shown in FIG. 1, however, on an enlarged scale.
Figure 5:
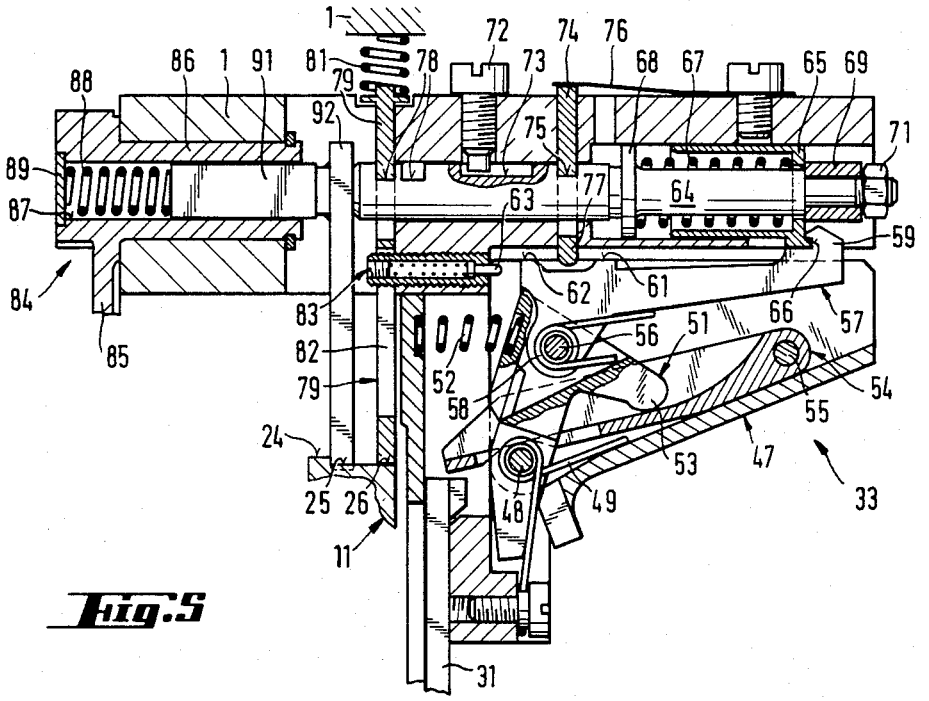

Trigger device 33, shown enlarged in FIGS. 4–7, is composed of an actuating catch 47 pivotally mounted about a pin 48 supported in the housing, so that the catch can be pivoted from a rest position, shown in FIG. 4, to a functioning position, shown in FIG. 5. A torsion spring 49 which biases the actuating catch into the rest position, is arranged on the pin 48. Pin 48 also serves as a pivot bearing for an angular lever 51 which is pressed in the clock-wise direction as shown in FIG. 4, by a compression spring 52. When the actuating catch 47 is pressed as shown in FIG. 5, a free leg 53 of the lever 51 is supported against a pivot lever 54, which is rotatably supported at the actuating catch by a pin 55. Accordingly, the free portion of the pivot lever 54 rests against the pin 48. Moreover, the end of the free portion of the pivot lever projects into the displacement path of the transmission rod 31 and this end of the rod is enlarged in the manner of a head. A tension member 57 is pivotally supported on the angular lever 51 by a pin 56. A torsion spring 58, is arranged on the pin 56 and is supported by an arm on the angular lever 51 so that the spring acts against the lower side of the lever 57 in the counterclockwise direction.

The tension lever 57 has a claw 59 at its free end, that is, its right-hand end as viewed in FIG. 1. A guide cam 61 is located on the upper side of the lever 57 and a nose or projection 62 is located at the opposite end of the lever from the claw 59.

Figure 6:
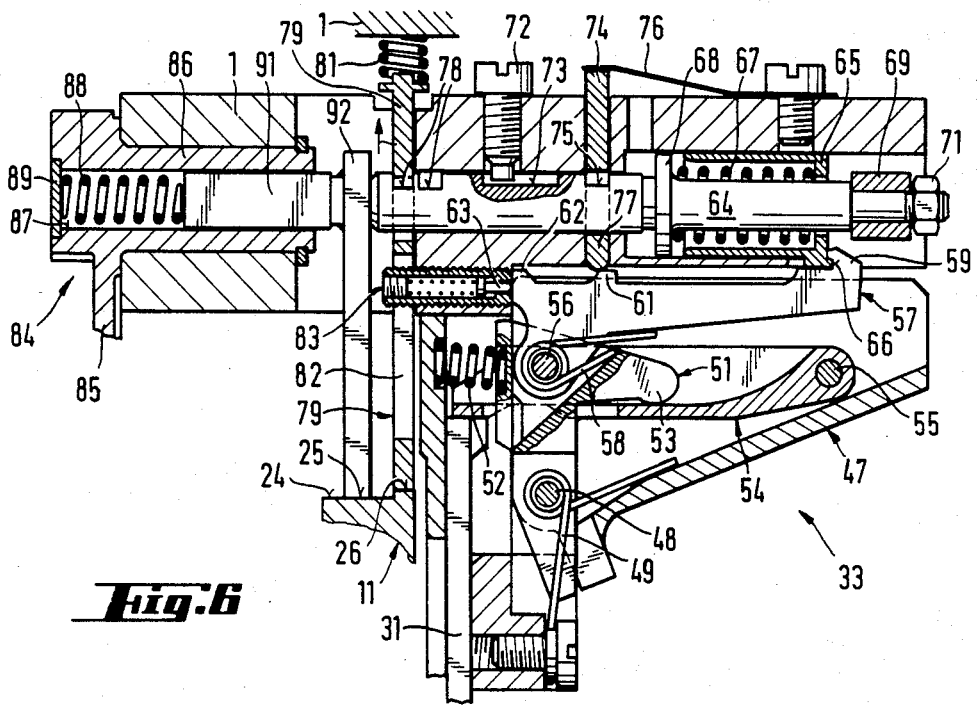
Figure 7:
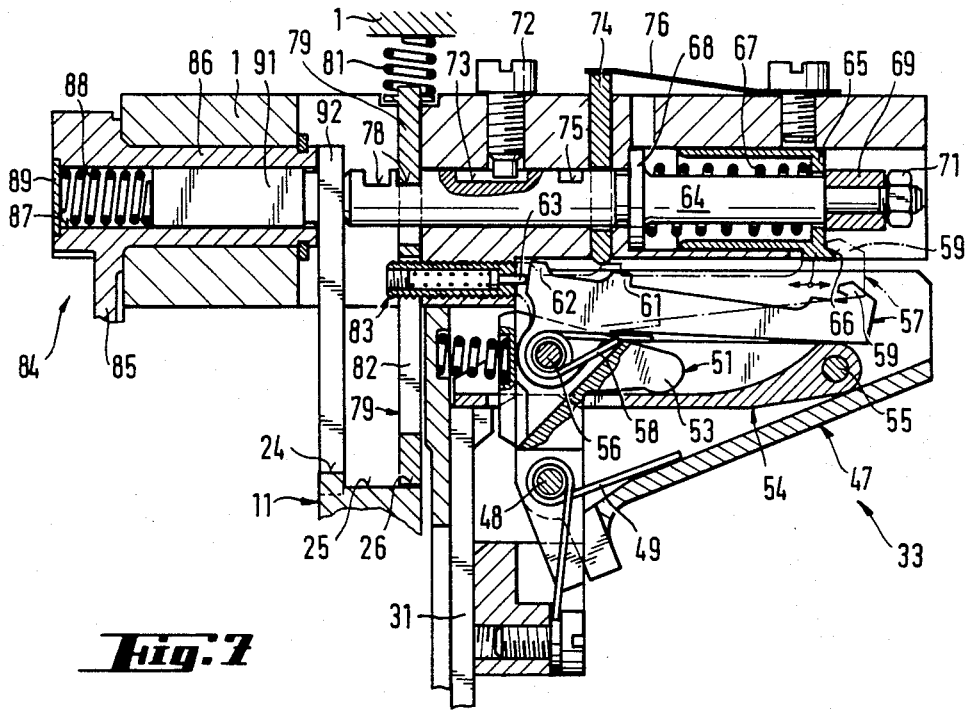

A spring-loaded pin 63 acts against the nose 62 in a certain functional position of the tension lever 57, note FIGS. 6 and 7, and the pin projects from the housing 1.

A bolt-like slider 64 is supported in the housing 1 above the tension lever 57. The slider 64 is located in a bush 65 which is concentric with the slider and is axially displaceable in the housing. A tooth-like projection 66 is formed at the end of the bush adjacent the claw 59 on the lever 57 so that the projection can interengage with the claw. As viewed in FIG. 4, bush 65 is pressed to the right by a compression spring 67 which is supported against an outwardly projecting flange or shoulder 68 on the slider 64. The bush 65 bears against a ring 69 which is held in position on the slider by a nut 71.

Located above the left-hand end of the slider 64 is a securing screw 72 which projects downwardly into a recess 73 extending in the axial direction of the slider so that the slider is prevented from rotating about its axis. In the rest position of the device, as shown in FIG. 4, a locking bolt 74 extends downwardly into engagement in a notch 75 in the slider 64 for preventing axial movement of the slide. A leaf spring 76 presses downwardly on the locking bolt 74 for holding it in place. The locking bolt 74 projects at its lower end into the effective region of the control cam 61 on the lever 57.

Further, the slider 64 has two notches 78 adjacent its left-hand end as viewed in FIG. 4. In the rest position of the device, a blocking slider 79 projects into the left-hand one of the notches 78. The blocking slider is retained in the engaged position by a compression spring 81 supported in the housing 1, only a portion of the housing is shown in FIG. 1. The blocking slider 79 is elongated in its acting direction, note it extends downwardly below the slider 64, and contains an elongated guide slot 82. A hollow pin 83 secured to the housing and displaceably supporting the pin 63, projects into the guide slot 82. Blocking slider 79 is also held at its lower end against the curved surface 26 on the outside of the driving element 11 by the compression spring 81. Only a portion of the driving element 11 is shown in FIGS. 4–7 indicating the curved surfaces 24, 25 and 26.

A pivotally mounted lever 84 supported in the housing 1 serves as an actuating device for the hook 34. The lever 84 is supported in the housing so that it is coaxial relative to the slider 64 and is located to the left of the slider as viewed in FIGS. 4–7. Lever 84 includes an arm 85, shown only in part in FIGS. 4–7, and a bearing bush 86 formed integrally with the arm. Bearing bush 86 is secured in the housing 1 so that it cannot be displaced in the axial direction. The bearing bush 86 forms a borehole 87 having a rectangular cross-section and a compression spring 88 is located in the borehole and is supported against a base 89 located at the left-hand end of the borehole. The right-hand end of the spring 88 bears against an axially displaceable pin 91 which also has a similar rectangular cross-section to that of the borehole. An arm 92 is fixed on the pin 91 outwardly of the bush 86 so that it cannot be rotated relative to the lever 84.

Figure 8:
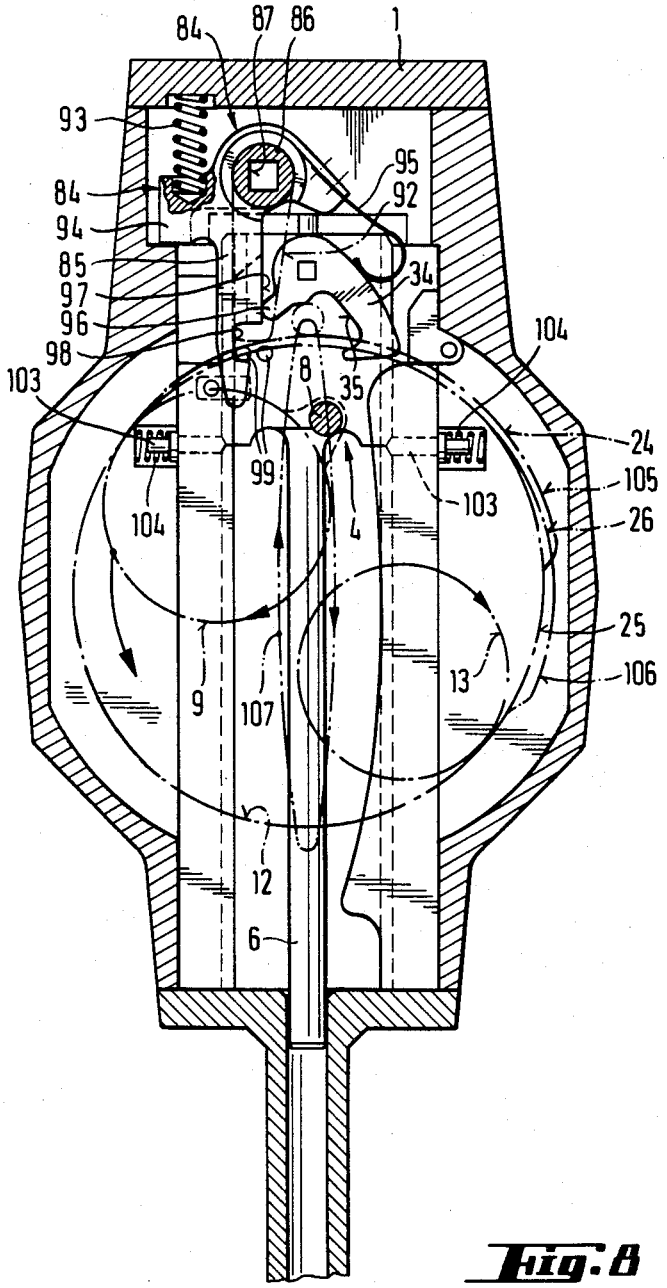
FIGS. 8–13 illustrate the control and actuating mechanism on the section VIII in FIG. 1.

In the rest position of the device as shown in FIG. 4, the free end of the arm 92, that is its lower end as viewed in the figure, is located in the path of the curved surface 25. The curved surface 25 is smoothed or concentric relative to the axis of the driving element. Compression spring 88 presses the pin 91 and, accordingly, the arm 92, against the left-hand face of the slider 64 so that the arm 92 is retained in the region of the curved surface 25. As illustrated in FIG. 8, a compression spring 93 supported in the housing 1, acts downwardly against a protuberance 94 on the lever 84 and presses the free or lower end of the arm 92 against the curved surface 25. In addition, FIG. 8 shows a spring 95 located at the lever 84 with the spring 95 acting on the opposite side of the hook 34 from the opening 35. Accordingly, cam 96 on hook 34 is pressed against a support surface 97 on the arm 85.

In the rest position of the device, a mouth-like recess 98 in the arm 85 holds one of the pins 99 which project from the lower part of the head 5. Driver rod 4 is held in the retracted position against the force of a compression spring 101 which acts on the upper portion of the head as viewed in FIG. 1, that is, the spring presses against a driving pin 102 downwardly against the upper portion of the head 5. In addition, catch pins 103 are provided which hold the lower end of the head 5 at its two sides, note FIG. 8. Springs 104 bias the catch pins 103 into the holding position as shown in FIG. 8.

In FIG. 8 certain elements located behind the section plane VIII are shown in phantom for a more complete understanding of the construction of the device. Accordingly, the smooth or concentric curved surface 25, the partly eccentric curved surface 24 with a cam or guide surface 105, and the curved surface 26 with a more eccentrically arranged cam or guide surface 106.

The hollow gear wheel 12 is indicated by its pitch circle which corresponds to the curved or circular contour of the curved surface 25. The planet pinion 9 and the support gear 13 are also shown by means of their pitch circle and as can be noted, these pitch circles roll or are meshed with the pitch circle of the hollow gear wheel 13. The pitch diameter of the planet pinion 9 corresponds to half the pitch diameter of the hollow gear wheel 12. The pin shaped carrier 8 mounted on the planet pinion 9 is located slightly outwardly from the pitch circle of the planet pinion.

The rotation of the planet pinion 9 and the support gear 13 in meshed engagement with the hollow gear wheel 12 is effected by the rotation of the driving element 11. As illustrated in FIG. 8 by the arrows, the planet pinion 9 runs, on one hand, around the axis of the driving element 11 which also corresponds to the central axis of the hollow gear wheel 12 and, on the other hand, the planet pinion rotates about its own axis. At the same time, the carrier 8 moves along the narrow elliptical path of movement 107. In a uniform linear rotating drive of the planet pinion 9, the carrier moves on its path of movement 107 with a sine-shaped velocity curve.

To operate the device, the drive motor is turned on and continues to run. Accordingly, the drive shaft rotates continuously keeping the drive element 11 along with the planet pinion 9 and the support gear 13 moving rotationally. The carrier 8 moves along its elliptical path of movement 107 at a higher frequency, for instance, fifty times per second. The curved surfaces 24, 25, 26 on the outside surface of the rotating drive element 11 rotate along with the element.

The arm 92 which pivots with the pin 91 is located, in the rest position, in the region of the smooth continuous curved surface 25, as indicated in FIG. 4, and, accordingly, does not experience any deflection or displacement. The blocking slider 79, on the other hand, is fixed against the curved surface 26 and the cam or guide surface 106 forming a portion of the curved surface 26 displaces the blocking slider outwardly against the force of compression spring 81 during each rotation of the driving element 11. When the blocking slider 79 is lifted by the cam surface, it disengages from the notch 78, however, this does not influence the slider 64 which is retained in the axial direction by the locking bolt 74. While the device idles, the remainder of the parts are maintained in their rest positions as can be seen in FIGS. 4 and 8.

When the trigger device 33 is actuated or squeezed by the user and the outlet 27 of the device is pressed against a workpiece, the nail driving operation can take place. By pressing the actuating catch 47, the catch along with the parts 51, 54, 57 move to the position shown in FIG. 5. The pressing of the outlet 27 of the device against a workpiece effects an inner movement of the safety stirrup 28 and its associated transmission rod 31. The rod 31 moves into contact with the free section of the pivot lever 54 and lifts the lever about its pin 55 into the horizontal position shown in FIG. 6. Since the free leg 53 of the angular lever 51 is supported on the pivot lever 54, the lever 51 is also pivoted about its pin 48 in the counterclockwise direction. This movement, in turn, results in a displacement of the pin 56 and of the tension lever 57 out of the position in FIG. 5 and into the position displayed in FIG. 6, that is, as viewed in the drawing, to the left. The nose 62 presses the pin 63 against the spring force.

This displacement of the tension lever 57 to the left, as mentioned above, initially effects the contact of the projection 66 by the claw 59 with the movement of the bush 65 against the force of the spring 67, and towards the end of compressing the spring 67, the control cam 61 disengages the locking bolt 74. The slider 64, note FIG. 6, is biased toward the left, however, it is prevented from moving to the left due to the blocking slider 79 until the guide surface 106 on the outside of the rotating driving element 11 lifts the blocking slider against the action of its spring 81 and causes it to disengage out of the left-hand notch 78. The slider 64 is then moved toward the left by the action of spring 67 and the slider is supported at the tension lever 57 by the bush 65 and, accordingly, also carries the pin 91 and the pivot arm 92 along with it in the left-hand direction against the somewhat weaker compression spring 88. During such movement, the end of the arm 92 moves into the range of the guide surface 24 from the guide surface 25. The guide surface 24 has the cam or guide surface 105.

In this operational position, which can be seen in FIG. 7, the blocking slider retains the slider 64 which moves into the right-hand notch 78 after passing out of the range of the guide surface 106 due to the biasing action of spring 81.

Towards the end of the above-mentioned displacement of the slider 64 to the left, the left-hand end of the ring or sleeve 69 contacts the base of the bush 65 in a pulse-like manner and moves it for a short distance to the left. Accordingly, projection 66 is disengaged from the claw 59. With this disengagement, the tension lever 57 is pivoted by the pretensioned pin 63 in the clockwise direction as shown in FIG. 7. Compression spring 67 then rests on the slider in a neutral manner.

Figure 9:
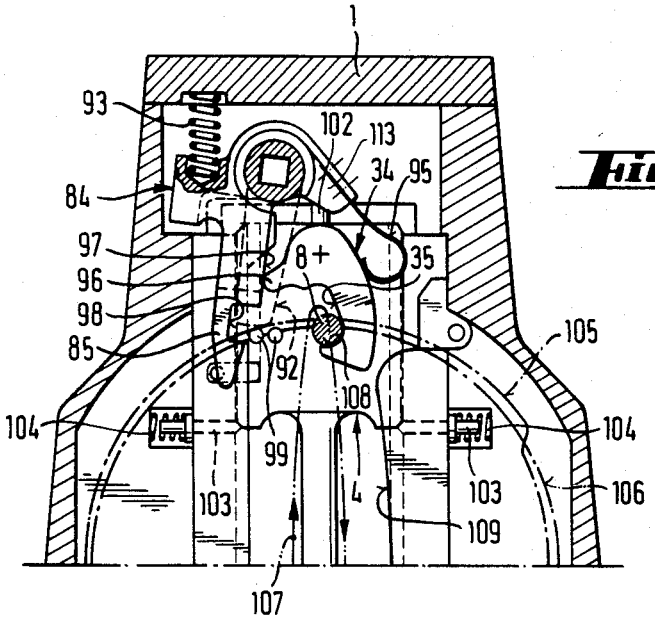

After the arm 92 is moved into the range of the curved surface 24, the continuously rotating driving element pivots the arm 92 and the lever 84 connected to it out of the rest position shown in FIG. 8 and into the outwardly displaced position shown in FIG. 9 due to the contact with the guide surface 105. As a result, spring 93 is more strongly compressed and suppresses any shock-like lifting of the arm 92 out of the region of the curved surface 24. Support surface 97 moves away from the rotational point of the hook 34 during the pivoting operation. Cam 96 on the hook 34 on which bending spring 95 acts, glides along the support surface 97. The hook 34 then pivots into the elliptical path of movement 107 of the carrier 8. The pivoting operation is controlled by the cooperation between the curved surface 24 and the arm 92 and its associated lever 84 so that the carrier does not collide with the pivoting hook 34, rather, the carrier moves into the opening 35 in the hook in a controlled manner.

The carrier moves along its path of movement as shown by the arrows and carries the hook 34 by its contact with a lower shoulder 108 in the opening 35 so that the driver rod is moved in the driving direction, note FIG. 9. To make this movement possible, the lever 84 or its recess 98 releases the pin 99. Catch pins 103 are forced outwardly when the drive rod commences its movement in the nail driving direction.

Figure 10:
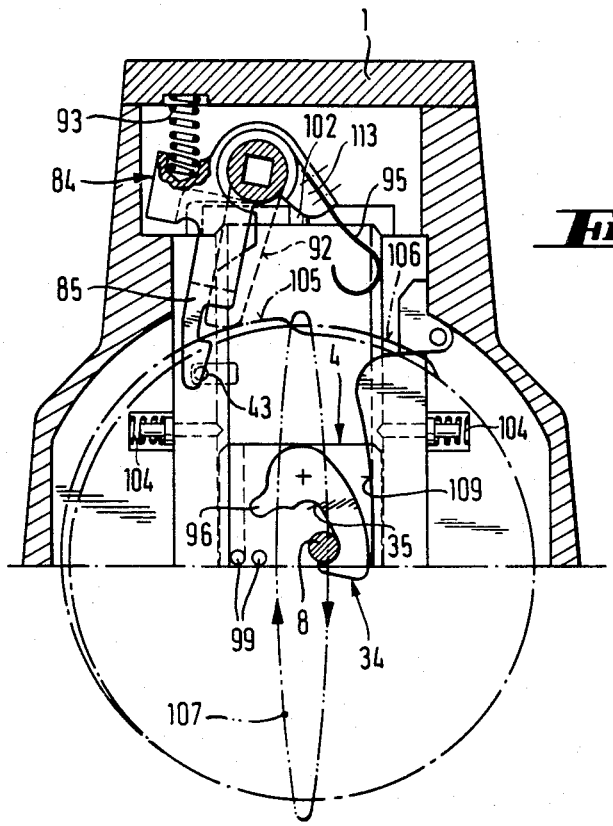

FIG. 10 shows the driver rod 4, in a partial view, moving in the driving direction. The hook 34 runs with its surface on the opposite side from the opening 35 along the supporting flank 109 on the housing, this flank has a configuration corresponding to the pivotal movement of the hook as it moves in the driving direction along with the driver rod. Along with the lever 84, note FIG. 10, the arm 92 pivots for the greatest amount away from the guide surface 105. The free end of the arm 85 overruns the retention pin 43, which is no longer held back by the driver rod for moving in the driving direction, and moves into the pivoting region of the arm 85. Accordingly, arm 85 is held in the maximum pivoted position by the retention pin 43.

Figure 11:
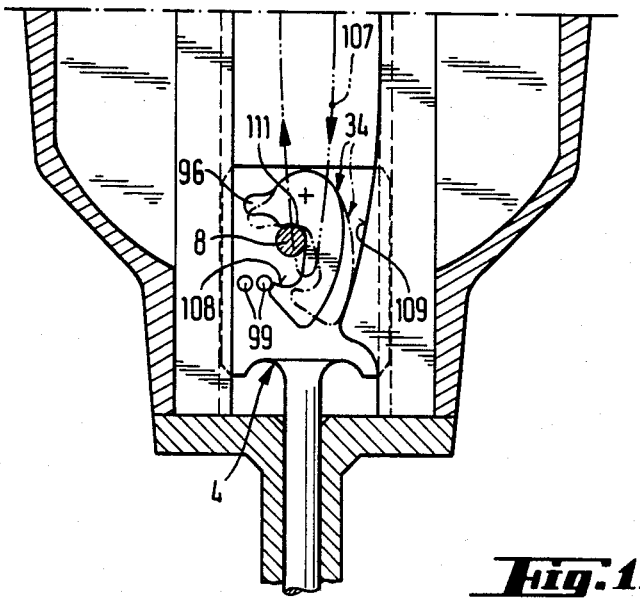

In FIG. 11 the reversing movement of the carrier 8 is shown. Initially, the carrier moves along in contact with the shoulder 108 of the hook 34 during the driving action. In the reverse movement the carrier bears against the rear shoulder 111 of the hook. Shoulder 111 is arranged so that the carrier exerts a turning movement on the hook 34 in the clockwise direction, in addition to the accelerating force in the return direction. The pivotal movement of the hook which results, is stopped by the right-hand pin 99 against which the end of the hook runs. A reliable engagement of the carrier 8 against the rear shoulder 111 is ensured.

Figure 12:
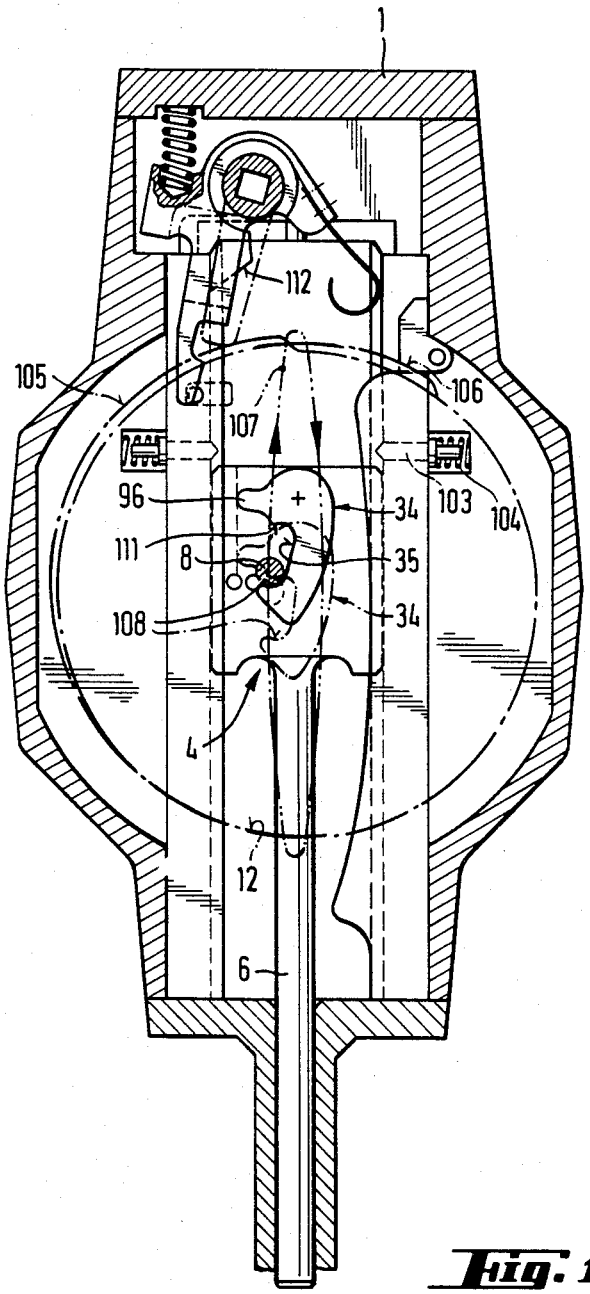

Carrier 8 accelerates out of the reversing position, according to FIG. 11, in a sine-like manner along approximately half of the upward length of the elliptical path of movement 107. Until the highest reverse velocity is reached, the carrier remains in engagement with the rear shoulder 111 in the hook 34. With the subsequent sine-shaped decleration of the carrier, a change in the position of the carrier relative to the shoulder 108 occurs due to the more rapid movement of the driver rod 4 as shown in FIG. 12. The torsion spring 37, as shown in FIGS. 2 and 3, holds the hook 34 in the pivoted engagement position with the carrier 8 during the reverse or return stroke.

Figure 13:
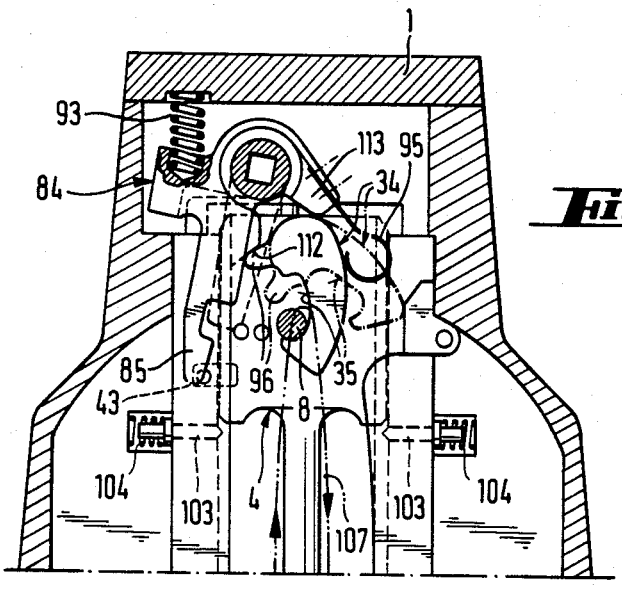

The driver rod 4 now braked by the slower moving carrier 8, continues to move in the reverse direction. Toward the end of the reverse stroke, cam 96 on the hook 34 runs against an inclined stop 112 on the housing 1. As shown in FIG. 13, hook 34 is pivoted out of the elliptical path of movement 107 of the carrier in the counterclockwise direction and is disengaged from the carrier 8. The carrier 8 continues to move along the path of movement 107.

Before the reverse end position of the driver rod 4 is reached, its head 5 forces the arm 45 and, accordingly, the retention pin 43, back against the compression spring 44, note FIGS. 2 and 3, thereby releasing the reverse pivotal movement of the arm 85 and its lever 84. The trailing end of the drive rod 4 then impacts against a radially projecting extension 113, note FIGS. 13, so that the lever 34 returns to its rest position, as shown in FIG. 8, moving in the counterclockwise direction. Subsequently, the driver rod is moved into the rest position by the driver pin 102 slightly toward the outlet end of the device against the catch pins 103 which contact the lower end of the head as viewed in the drawing. One pin 99 engages in the recess 98 of the arm 85 and secures the driver rod 4 in the rest position.

Immediately after the maximum pivoting movement of the lever 84 is reached, note FIG. 10, the guide surface 106 again lifts the blocking slider 79 so that it disengages out of the right-hand notch 78 as shown in FIG. 7. The compression spring 88 returns the arm 92 and the slider 64 toward the right into the rest position by means of the pin 91. The arm 92 is again located in the region of the curved surface 25, as set forth in FIG. 4. The blocking slider 79 falls into the left-hand notch 78 after passing out of the range of the control surface 106 and the leaf spring 76 reengages the locking bolt 74 in the notch 75. Accordingly, slider 64 is retained in the rest position.

After the device is lifted from the workpiece, the compression springs 29, 32 displace the safety stirrup 28 and its transmission rod 31 into the rest position as displayed in FIG. 1. When the user releases the trigger mechanism 33 then the condition of the device as shown in FIGS. 1, 4 and 8 is attained.

While specific embodiments of the invention have been shown and described in detail to illustrate the application of the inventive principles, it will be understood that the invention may be embodied otherwise without departing from such principles.

We claim:

1. A device for driving nails and similar fastening elements includes a driver rod for driving in the nails and a driving unit including a driving element moving through a rotational cycle for driving said driver rod, said driving element is connectable with said driver rod for transmitting a substantially rectilinear motion thereto, wherein the improvement comprises that said driving element includes a carrier engageable with said driver rod with said carrier moving along an elongated path of movement generally in the direction of the rectilinear movement of the driver rod, said driver rod includes a coupling device for connecting said carrier to said driver rod in the rotational cycle of said driving element, said driving element includes a planet pinion mounted on and rotated by said driving element, said carrier is secured to said pinion, a hollow gear wheel encircles said planet pinion and is coaxial with said driving element, said planet pinion rolls in meshed engagement with said hollow gear wheel, and the pitch diameter of said planet pinion corresponds to half of the pitch diameter of said hollow gear wheel.

2. A device, as set forth in claim 1, wherein the axis of said carrier is located parallel to the axis of said planet pinion and is located outside of the pitch circle defined by the pitch diameter of said planet pinion.

3. A device, as set forth in claim 2, wherein said driving element includes at least one support gear in rolling meshed engagement with said hollow gear wheel and mounted on said driving element for rotation therewith.

4. A device, as set forth in claim 1 or 2, wherein said carrier is in the form of a crank pin located on said planet pinion.

5. A device, as set forth in claim 1 or 2, wherein said coupling device has an opening therein for receiving said carrier.

6. A device, as set forth in claim 5, wherein said coupling device is a hook-shaped member containing said opening and said hook shaped member is pivotally mounted on said driver rod.

7. A device, as set forth in claim 6, including an actuating device for pivoting said hook-shaped member into the coupled position with said carrier for connecting said carrier and said driver rod.

8. A device, as set forth in claim 6 or 7, including a stop member located in the path of said hook-shaped member for disengaging said hook-shaped member and said carrier.

9. A device for driving nails and similar fastening elements includes a driver rod for driving in the nails and a driving unit including a driving element moving through a circular rotational cycle for driving said driver rod, said driving element is connected with said driver rod for transmitting a substantially rectilinear motion thereto, wherein the improvement comprises that said driving element includes a carrier selectively engageable with said driver rod with said carrier moving along a narrow elongated elliptical path of movement with the path of movement being elongated generally in the direction of the rectilinear movement of the driver rod, said driver rod includes a coupling device for selectively connecting said carrier to said driver rod in the rotational cycle of said driving element, said driving element includes a planet piston mounted on and rotated by said driving element, said carrier is secured to said planet pinion, a hollow gear wheel having gear teeth in the inside surface of said gear wheel encircles said planet pinion and is coaxial with said driving element, said planet pinion rolls in meshed engagement with the gear teeth on the inside of said hollow gear wheel, and the pitch diameter of said planet pinion corresponds to half of the pitch diameter of said hollow gear wheel.

10. A device, as set forth in claim 9, wherein the axis of said carrier is located parallel to the axis of said planet pinion and is located radially outwardly from the pitch circle defined by the pitch diameter of said planet pinion.

11. A device, as set forth in claim 10, wherein said driving element includes at least one support gear in rolling meshed engagement with said gear teeth on the inside of said hollow gear wheel and mounted on said driving element for rotation therewith, said support gear being in spaced relation to said planet pinion.

12. A device, as set forth in claim 9 or 10, wherein said carrier is in the form of a crankpin located on said planet pinion.

13. A device, as set forth in claim 9 or 10, wherein said coupling device has an opening therein for receiving said carrier.

14. A device, as set forth in claim 13, wherein said coupling device is a hook-shaped member containing said opening and said hook-shaped member is pivotally mounted on said driver rod.

15. A device, as set forth in claim 14, including an actuating device for pivoting said hook-shaped manner into the coupled position with said carrier for connecting said carrier and said driver rod.

16. A device, as set forth in claim 14 or 15, including a stop member located in the path of said hook-shaped member for disengaging said hook-shaped member and said carrier.

* * * * *